US005660158A

United States Patent [19]

Rudolph

[11] Patent Number: 5,660,158

[45] Date of Patent: Aug. 26, 1997

[54] DYNAMIC BOW LIMB FIXATION WITH A POINT SHAPED VARIABLE SUPPORT AND LEAKPROOF (WATER TIGHT) ENCLOSURE FOR BOWS

[76] Inventor: Siegfried Rudolph, Kolbergstr. 2, 28832 Achim, Germany

[21] Appl. No.: 399,087

[22] Filed: Mar. 8, 1995

[51] Int. Cl.[6] ..... F41B 5/00

[52] U.S. Cl. ..... 124/23.1

[58] Field of Search ..... 124/23.1, 25.6, 124/86, 88

[56] References Cited

U.S. PATENT DOCUMENTS

| | | | |
|---|---|---|---|
| 3,635,205 | 1/1972 | Wood . | |
| 3,757,761 | 9/1973 | Izuta . | |
| 3,812,835 | 5/1974 | Smith . | |
| 3,942,506 | 3/1976 | Izuta | 124/88 X |
| 4,989,577 | 2/1991 | Bixby | 124/25.6 |
| 5,025,774 | 6/1991 | Martin | 124/89 |
| 5,231,970 | 8/1993 | Ploot et al. | 124/23.1 |
| 5,339,790 | 8/1994 | Smith | 124/25.6 |
| 5,373,831 | 12/1994 | Cushman | 124/25.6 |
| 5,433,792 | 7/1995 | Darlington | 124/25.6 |

FOREIGN PATENT DOCUMENTS

| | | | |
|---|---|---|---|
| 19498 | 2/1977 | Japan | 124/23.1 |

*Primary Examiner*—John A. Ricci
*Attorney, Agent, or Firm*—Brooks & Kushman P.C.

[57] ABSTRACT

A dynamic bow limb fixation having a point contact variable support and a water-tight enclosure for bows has the task of reducing vibrations of the bow limbs to the riser. The bow limbs are fixed in a floating manner so as to reduce torsion tension when the bow is drawn. The purpose of fixing the limbs in a floating manner is to get a better release of the arrow. The variability of the limb fixation makes possible the tuning of the bow by the archer so that efficiency and effectiveness of the bow is optimized. The combination of the point contact and the support of the bow limbs by a stack of plate springs is of central importance for the advantages of dynamic bow limb fixation. It is also critical that the stack of plate springs is protected in a waterproof enclosure.

17 Claims, 2 Drawing Sheets

DYNAMIC BOW LIMB FIXATION WITH A POINT SHAPED VARIABLE SUPPORT AND LEAKPROOF (WATER TIGHT) ENCLOSURE FOR BOWS

TECHNICAL FIELD

The invention is related to the field of archery bows and, in particular, to a bow limb attachment system.

BACKGROUND ART

Bow limb attachment systems are described by Kaneko in Japanese patent 52,19498 and by S. Rudolph in German patent DE 39 27 336 C2. The bow limb attachment taught by Kaneko has the disadvantage that the bow limb is supported in a slot with a spiral spring. This spiral spring is supposed to store the energy for the shooting of an arrow. As a result, the bow limb functions as a lever. There is an inherent disadvantage in the lever/spiral spring combination taught by Kaneko in that the system acts completely undamped at the time of release of the arrow which results in an unsteady release. Further, the material structure of the bow is subject to strain and vibration of attachments to the bow such as a bow sight.

The usual solution to dealing with undesired vibrations is to install a stabilizer on the bow which has vibration dampening characteristics or to mount the bow in a vibration damper. The disadvantage with stabilizers is that the vibration from the limbs are transmitted through the riser before entering, the stabilizer and start to be reduced.

The bow limb attachment system taught by Rudolf reduces the problems of the limb attachment system taught by Kaneko to a considerable extent. However, the structure taught by Rudolf has other serious disadvantages. The limb of the low attachment system disclosed by Rudolf is supported in a limb pocket provided in the riser in a linear way such that the limb can only move about one axis. This restriction of the movement of the limb relative to the riser about a single axis is a disadvantage because very few archers are capable of drawing the bow ninety degrees relative to the limb. As a result, there is a twisting of the limbs which naturally is the greatest at the nock ends.

Further, in the limb attachment arrangement taught by Rudolf, when the bow is shot and the limbs return to their resting positions, the tension is equalized rapidly, giving a shock which causes a sideward movement of the string. This sideward movement has an adverse effect on the arrow as it leaves the bow. To withstand this effect, the arrow has to be stiffer and heavier.

Still further, the limb attachment mechanism taught by Rudolf has the problem that the stack of plate springs which dampen the vibrations is subject to the negative influences of water and dust which can get into the stack of plate. The water can come from rain or splashing. When water gets into the stack of plate springs, there is a change in the sound which can disturb the archer. There are further problems resulting from water getting into the stack of plate springs, such as the water lubricates the stack of plate springs so that they act differently as compared to when they are dry. The water can also cool the stack of plate springs which can also change the vibration dampening effect. Further, over a period of time, the water can also corrode the individual springs in the stack. This corrosion changes the friction characteristics of the plate springs which, along with the other problems mentioned above, changes the force draw curve of the bow.

DISCLOSURE OF THE INVENTION

The invention is a limb attachment mechanism for a take-down bow. This bow may be a long bow or a compound bow. The limbs are attached to a riser by means of a bolt system which includes a stack of plate springs and a thickened washer in a recess. The stack of plate springs is isolated from water and dust by leakproof washers as well as a pressure washer. The other point of contact of the limbs with the riser is a single semi-spherical bearing which acts like a hinge or fulcrum. The semi-spherical bearing is mounted on an axis of the riser by a conic pin received in a slot to keep the limb centered with respect to the riser. This allows the limb to rotate about two different axes. The first axis is limb end to riser axis and the other axis is perpendicular to the first axis. The limb is mounted like a seesaw with the semi-spherical bearing acting as a fulcrum.

The advantages of the limb attachment system for a bow will become more apparent from a reading of the specification in conjunction with the drawings.

BEST MODE FOR CARRYING OUT THE INVENTION

Figure 1:
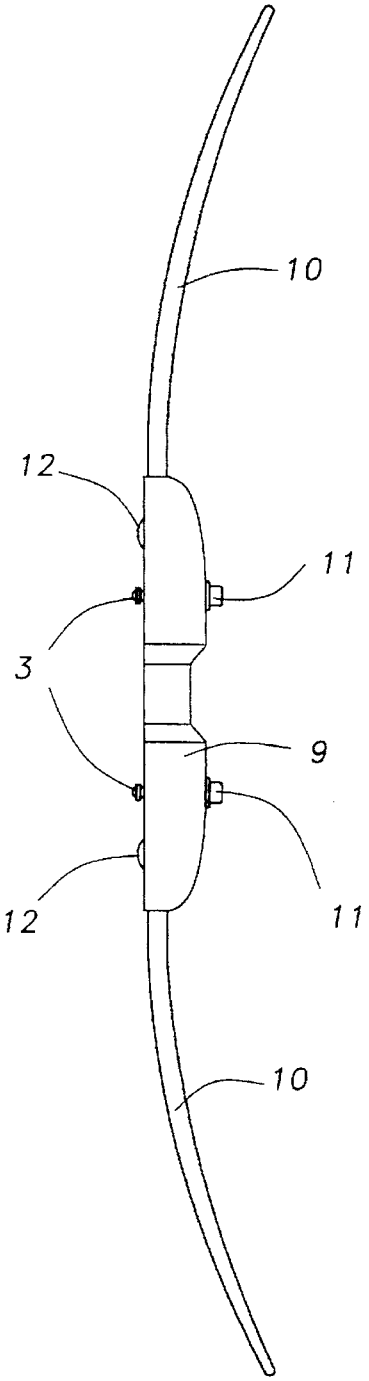
FIG. 1 is a side view of an archery bow.
Figure 3:
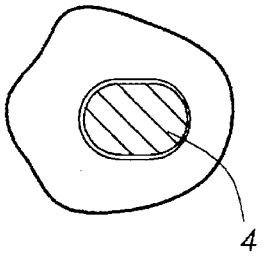
FIG. 3 is a cross-section of the bolt 4.
Figure 4:
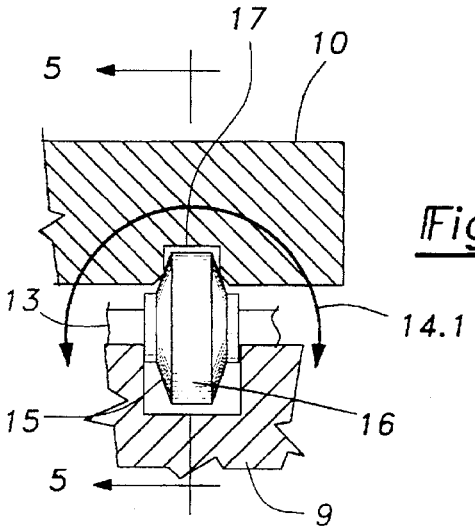
FIG. 4 is a partial cross-sectional end view of an alternate embodiment of the fulcrum.
Figure 5:
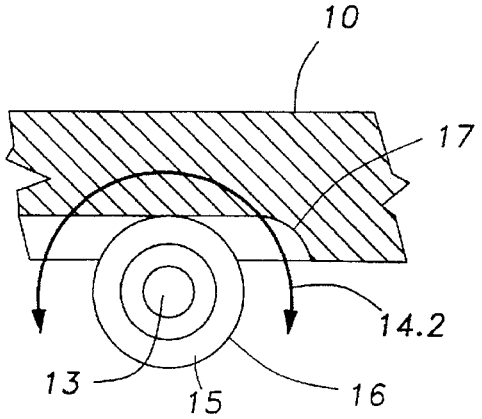
FIG. 5 is a partial cross-sectional side view of the embodiment shown in FIG. 2.

Referring to FIG. 1, there is shown an archery bow having a pair of limbs 10 attached to a riser 9. Each of the limbs 10 is supported in a riser pocket 9 by means of a semi-spherical bearing with a cone-shaped pin 1 in a bearing receiver slot. The bearing receiver is also semi-spherical and has a bored out socket to receive the cone-shaped pin. This support allows for some movement of the limb about a second axis as shown FIG. 4. Bolt anchor 4 in the riser 9 must also have some freedom of movement about a first axis so that the limb 10 can move about two axes 14.1 and 14.2 as shown in FIGS. 4 and 5. As a result, the torsion shock is reduced because the limb 10 can rotate in the riser 9. This rotation reduces unwanted string sidewards movement which reduces the accuracy of the bow. The noise from the shot is also reduced. A stack of plate springs 6 abut a pressure washer 5.3 and are secured to the bolt anchor 4 by an adjustment nut 7 and lock nut 8 which may be used to adjust the spring rate of the stack of plate springs 6. The shape of the bolt anchor 4 is oblong and is received in an oblong hole, as shown in FIG. 3. The middle of the limb 10 is attached and kept centered in the riser 9 by means of the semi-spherical bearing having a cone-shaped pin 1 received in a bearing receiver slot 2. The problems (disadvantages) that occur when water or dust get into the stack of plate springs 6 are done away with by means of the leakproof washers 5.1 and 5.2. These washers are made of an elastic material, like rubber. An anchor bolt 4 has a large diameter portion with a recess for the leakproof washer 5.1 which fits tightly.

When the bow is drawn, the bolt 3 received in anchor bolt 4 pulls up on the adjustment nut 7 which exerts pressure on the stack of plate springs 6 which, in turn, exerts pressure on the pressure washer 5.3. The pressure washer 5.3, in turn, puts pressure on the leakproof washer 5.2 which puts pressure on the riser 9. When the bow is not drawn, there is pressure on the leakproof washer 5.1 In this way, the stack of plate springs 6 is protected from water and dust both when the bow is drawn and when it is at rest. The belly side of the bow has a dust/waterproof cap 11 to protect that side of the stack of plate springs 6 from water and dust.

Figure 2:
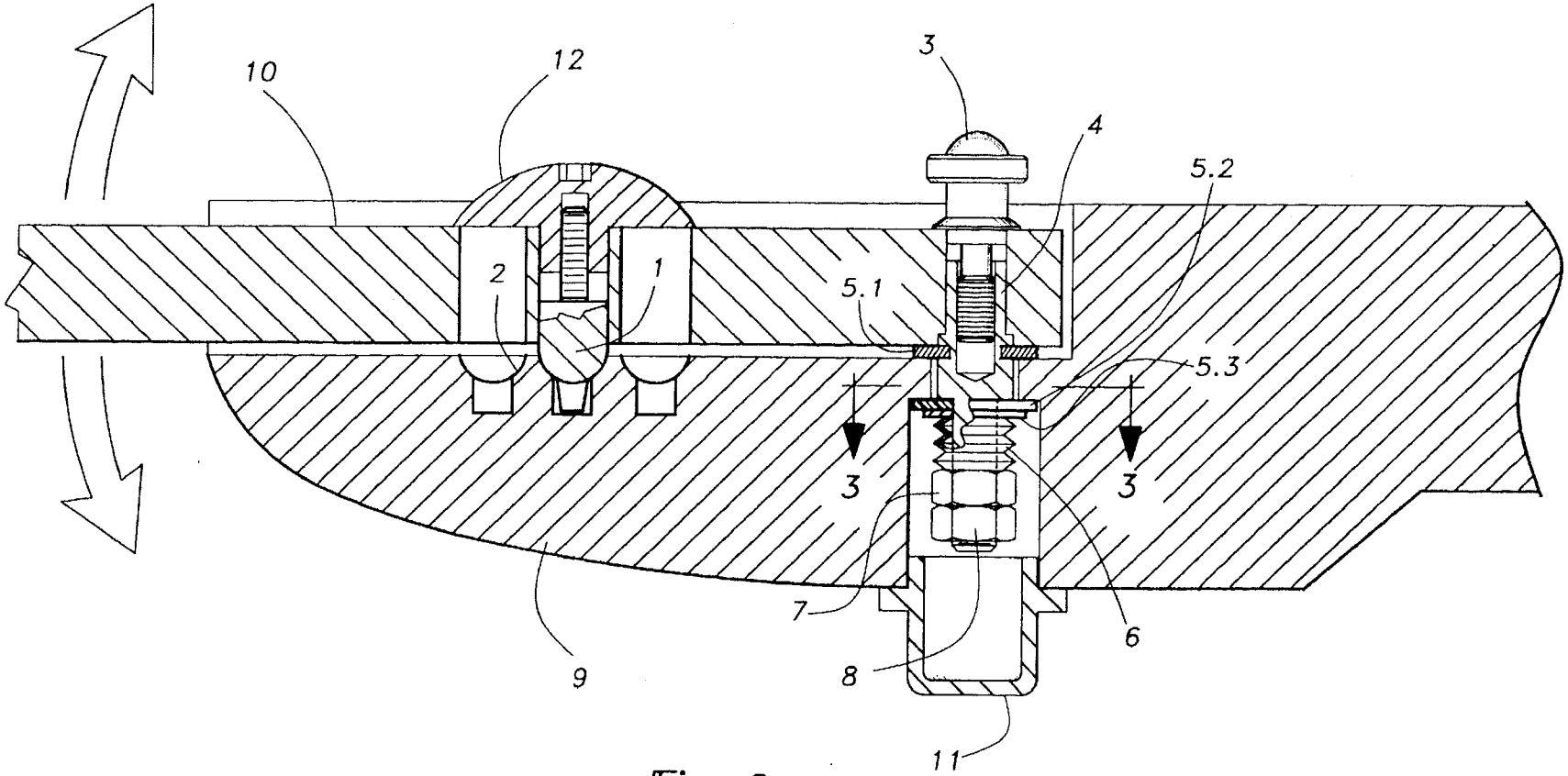
FIG. 2 is a partial cross-sectional view showing the details of the attachment of the limbs to a riser.

There is a further advantage to the bow limb attachment, in accordance with the invention which applies mainly to compound bows. By changing the distance between the semi-spherical rest point 1 and the anchor bolt 4, the degree of efficiency of the bow can be raised. As is mentioned in German patent DE 39 27 336 C2, the energy of the limbs 10 at full draw is equal to the energy stored in the stack of spring plates 6. By optimizing the leverage ratio between the limb ends, the semi-spherical bearing and the anchor bolt, the energy stored in the stack of plate springs 6 can be modified to optimize the initial acceleration of the limbs. The distance between the support point determined by the location of semi-spherical bearing and the anchor bolt 4 can be adjusted to locate the optimal ratio by means of limb pocket adjustments using alternate bored-out sockets 2, in shown FIG. 2.

The stack of plate springs 6 is capable of storing a lot of energy while only being compressed a short distance, but the limbs 10 must travel a much longer distance. The shortness of the distance the stack of plate springs 6 travel results in an explosive-like setting free of the energy stored therein. When the ratios between the end of the limb, the location of the semi-spherical bearing and the location of the anchor bolt are optimal, the bow has the highest initial speed and thus has the highest degree of efficiency.

The height screw 12 adjusts the tiller and with it the draw weight of the bow. It raises or lowers the spherical point of contact with the limb 10. This is in addition to the height adjustment described by Rudolph in German patent DE 39 27 336 C2. This same effect could also be achieved by using various axles 13, as shown in FIGS. 4 and 5, in such a way that the various diameters change the tiller. The principle remains the same.

It is also possible to mount a spherical bearing 15 on an axle 13 as shown on FIGS. 4 and 5 which turns eccentrically in order to achieve an eccentric effect. Thus, the height of the spherical bearing 15 could be adjusted by means of the eccentric axle 13. In this case, the limb rests on a positioning bearing on the axle 13. The centering of the limb 10 is achieved by means of a conic revolving flange 16 provided on the eccentric axle 13 which is secured in a slot 17 disposed at a right angle to the axle 13.

I claim:

1. A take down archery bow having a riser and a pair of limbs comprising:

a pair of bolt systems for resiliently attaching the ends of said pair of limbs to the riser at predetermined locations displaced from the ends of said riser; and a single fulcrum provided between said riser and each of said limbs at a location intermediate a respective end of said riser and said bolt system, said single fulcrum permitting angular displacement of each of said limbs relative to the riser about two axes perpendicular to each other.

2. The take down bow of claim 1 wherein said take down bow is a long bow.

3. The take down bow of claim 1 wherein said take down bow is a recurve bow.

4. The take down bow of claim 1 wherein said take down bow is a compound bow.

5. The take down bow of claim 1 wherein each of said bolt systems comprises:

a bolt anchor attached to the limb on a side adjacent to the riser, said bolt anchor having a flange abutting said side of said limb adjacent to the riser, said bolt anchor having a shaft extending into a recess provided in the riser, said shaft having a threaded portion adjacent to its end;

a bolt for securing the bolt anchor to the limb;

a first leak proof washer circumscribing said shaft between the limb and the riser;

a second leak proof washer disposed in said recess, said second leak proof washer circumscribing said shaft at a bottom of said recess;

a pressure washer circumscribing said shaft adjacent to said second leak proof washer;

a stack of plate springs circumscribing said shaft adjacent to said pressure plate; and an adjustment nut thread on the threaded portion of said shaft to compress said stack of plate springs and generate a resilient force biasing said limb towards riser, said biasing force being sufficient for said first and second leak proof washers to provide a leak proof seal in the vicinity of the bolt anchor.

6. The take down bow of claim 5 further including a leak proof cap covering said recess to hermetically seal said recess and said stack of plate springs from dust and water.

7. The take down archery bow of claim 1 wherein each of said single fulcrums comprises:

a semi-spherical bearing seat provided in said riser intermediate said respective end of said riser and one of said bolt systems; and a single semi-spherical bearing attached to said limb on the side facing the riser, said single semi-spherical bearing being received in a respective one of said semi-spherical bearing seats and spacing said limbs from said riser, said semi-spherical bearing acting as said single fulcrum permitting the angular displacement of said limbs relative to the riser about said two axes perpendicular to each other.

8. The take down archery bow of claim 7 further comprising means for changing the location of said fulcrum formed by said semi-spherical bearing and said semi-spherical bearing seat relative to said bolt system.

9. The take down archery bow of claim 8 including a height adjustment screw for displacing the position of said semi-spherical bearing relative to said limb thereby adjusting a tiller and draw weight of the archery bow.

10. The take down archery bow of claim 7 wherein each of said semi-spherical bearings has a conical pin extending axially from its end and wherein said semi-spherical bearing seat provided in the riser has a cylindrical cavity receiving said conical pin.

11. The take down archery bow of claim 1 wherein each of said single fulcrums comprises:

a bearing recess provided in said riser adjacent said limb at location intermediate said end of said riser land said bolt system;

a longitudinal slot provided in said limb on the side facing said bearing recesses;

a spherical positioning bearing disposed in said bearing recesses and supporting said limb relative to said riser, said spherical bearing having an axle supporting said bearing within said bearing recesses and a conic revolving flange disposed at a right angle to said axle, said conic revolving flange received in said longitudinal slot to center said limb relative to said riser.

12. The take down archery bow of claim 11 wherein said axle is eccentric relative to said positioning bearing to permit a height adjustment of the limb relative to the riser.

13. A take down archery bow comprising:

a riser having a pair of recesses disposed a predetermined distance from each end;

a pair of limbs attachable to the opposite ends of said riser;

a bolt system for resiliently attaching each of said limbs to said riser, said bolt system having;:

a bolt anchor attachable to the end of the limb to be attached to the riser, said bolt anchor having a radial flange engaging the limb on the side adjacent to the riser and a shaft extending into a respective one of said pair of recesses, said shaft having a threaded portion;

means for securing said bolt anchor to said limb;

a first leak proof washer circumscribing said shaft between said limb and said riser;

a second leak proof washer disposed in said recess adjacent to a bottom thereof;

a pressure washer disposed in said recess adjacent to said second leak proof washer;

a stack of plate springs disposed in said recess circumscribing said shaft adjacent to said pressure washer;

at least one nut threaded on said threaded portion of said shaft to compress said stack of plate springs to produce a resilient force urging said limb in a direction towards said riser, said resilient force sufficient for said first and second leak proof washers to make a leak proof seal inhibiting water and dirt from entering said recess in the vicinity of said shaft;

said take down archery bow further comprising:

a semi-spherical bearing attached to each of said limbs on the side adjacent to said riser, said semi-spherical bearings attached to said limbs at a location intermediate said bolt anchor and the ends of the riser; and a pair of bearing seats provided in said riser, each bearing seat adapted to be engaged by a respective one of said semi-spherical bearings, said semi-spherical bearings engaged in said bearing seats functioning as a pair of single point fulcrums for the angular displacement of each of the limbs relative to the riser.

14. The take down archery bow of claim 13 wherein said semi-spherical bearing has a conical pin extending axially therefrom and wherein said bearing seat has a cylindrical cavity receiving said conical pin.

15. The take down bow of claim 13 further including a pair of leak proof caps, each leak proof cap covering a respective one of said pair of said recesses to hermetically seal said recesses and said stack of plate springs disposed in each recess from dust and water.

16. The take down archery bow of claim 13 further comprising means for changing the location of said fulcrum formed by said semi-spherical bearing and said bearing seat relative to said bolt system.

17. The take down archery bow of claim 13 including a height adjustment screw for displacing the position of said semi-spherical bearing relative to said limb thereby adjusting a tiller and draw weight of the archery bow.

* * * * *